US005830001A

United States Patent [19]

Kinoshita et al.

[11] Patent Number: 5,830,001

[45] Date of Patent: Nov. 3, 1998

[54] CONNECTOR CAPABLE OF RELIABLY LOCKING A PLUG CONNECTOR TO A RECEPTACLE CONNECTOR

[75] Inventors: Hiroaki Kinoshita; Tadashi Ishiwa, both of Tokyo, Japan

[73] Assignee: Japan Aviation Electronics Industry, Limited, Tokyo, Japan

[21] Appl. No.: 801,485

[22] Filed: Feb. 18, 1997

Related U.S. Application Data

[63] Continuation of Ser. No. 414,303, Mar. 31, 1995, abandoned.

[51] Int. Cl.[6] ..... H01R 13/627

[52] U.S. Cl. ..... 439/354; 439/680

[58] Field of Search ..... 439/677, 678, 439/679, 680, 681, 350, 354, 357, 358, 682, 903

[56] References Cited

U.S. PATENT DOCUMENTS 3,399,374 8/1968 Pauza et al. ..... 439/680
4,986,769 1/1991 Adams, III et al. ..... 439/681
5,254,018 10/1993 Sawada ..... 439/680
5,362,248 11/1994 Hashiguchi et al. ..... 439/350
5,389,006 2/1995 Noschese ..... 439/354

*Primary Examiner*—Hien Vu
*Attorney, Agent, or Firm*—Laff, Whitesel, Conte & Saret, Ltd.

[57] ABSTRACT

A connector comprises a combination of a plug connector and a receptacle connector. The plug connector has a plug insulator provided with first plug-side engaging portions formed on opposite side walls thereof, and at least one second plug-side engaging portion formed on a part of the plug insulator that is parallel to a width direction of the plug insulator. The receptacle connector has a receptacle insulator provided with first receptacle-side engaging portions formed on opposite side walls thereof to be engaged with the first plug-side engaging portions, and at least one second receptacle-side engaging portion formed on a part of the receptacle insulator that is parallel to a width direction of the receptacle insulator to be engaged with the second plug-side engaging portion.

5 Claims, 7 Drawing Sheets

CONNECTOR CAPABLE OF RELIABLY LOCKING A PLUG CONNECTOR TO A RECEPTACLE CONNECTOR

This application is a continuation of application Ser. No. 08/414,303, filed Mar. 31, 1995, now abandoned.

BACKGROUND OF THE INVENTION

This invention relates to a connector comprising a combination of a plug connector and a receptacle connector and, in particular, to a connector which is capable of reliably locking a plug connector and a receptacle Connector to each other even when the receptacle connector has a greater number of contact elements than those of the plug connector. The connector according to this invention has a structure adapted as an interface connector for use in a modern or the like.

A conventional connector of the type described comprises a plug connector and a receptacle connector to be connected to the plug connector as a mating connector.

The plug connector contains a plurality of first contact elements and a plug insulator. The first contact elements are arranged in parallel to one another on a first plane and secured to the plug insulator. Each of the first contact elements has a first contacting portion. The plug insulator is provided with an envelope portion which surrounds the first contacting portions.

The receptacle connector contains a plurality of second contact elements and a receptacle insulator. The second contact elements are arranged in parallel to each other on a second plane and are secured to the receptacle insulator. Each of the second contact elements has a second contacting portion to be brought into contact with a corresponding one of the first contacting portions when the plug connector is fitted to the receptacle connector with the first plane being in parallel with the second plane. The receptacle insulator has a receiving portion which surrounds the second contacting portions so as to receive the envelope portion of the plug insulator when the plug connector is fitted to the receptacle connector.

The plug insulator further comprises a pair of first plug-side engaging portions. The first plug-side engaging portions are respectively formed on outer surfaces of opposite end walls of the envelope portion, which surfaces extend in parallel to a third plane perpendicular to the first plane.

The receptacle insulator further comprises a pair of first receptacle-side engaging portions. The first receptacle-side engaging portions are formed on inner surfaces of opposite end walls of the receiving portion, which surfaces extend in parallel to a fourth plane perpendicular to the second plane. When the plug connector is fitted to the receptacle connector, the first receptacle-side engaging portions are engaged with the first plug-side engaging portions to releasably fix the plug insulator to the receptacle insulator with the envelope portion inserted into the receiving portion.

In the connector of the type described, a force required to remove the plug connector from the receptacle connector connected thereto is equal to a sum of a total frictional force and a total locking force. The total frictional force is a product of a frictional force acting between each pair of the first and the second contact elements and the number of the pairs of the first and the second contact elements. The total locking force is a sum of locking forces produced by engagement of the first plug-side engaging portions and the first receptacle-side engaging portions.

In the connector of the type described, the plug connector is generally connected to the receptacle connector having the second contact elements equal in number to the first contact elements of the plug connector.

However, in some instances, the plug connector is desired to be connected to the receptacle connector having the contact elements greater in number than those of the plug connector. This means that the width of the envelope portion of the plug insulator is narrower than that of the receiving portion of the receptacle insulator. In this event, only one of the first plug-side engaging portions formed on the opposite end walls of the envelope portion is engaged with a corresponding one of the first receptacle-side engaging portions. This results in a disadvantage that the plug connector is readily released from the receptacle connector because the above-mentioned total locking force is reduced down to a half.

SUMMARY OF THE INVENTION

It is therefore an object of this invention to provide a connector capable of reliably locking a plug connector to a receptacle connector even if the number of first contact elements of the plug connector is smaller than that of second contact elements of the receptacle connector.

A connector to which this invention is applicable comprises a combination of a plug connector and a receptacle connector to be connected to the plug connector as a mating connector. The plug connector comprises a plurality of first contact elements having first contacting portions, respectively, and arranged in parallel to one another on a first plane, and a plug insulator holding the first contact elements and having an envelope portion which surrounds the first contacting portions. The receptacle connector comprises a plurality of second contact elements having second contacting portions to be brought into contact with the first contacting portions, respectively, and arranged in parallel to each other on a second plane, and a receptacle insulator holding the second contact elements and having a receiving portion which surrounds the second contacting portions so as to receive the envelope portion of the plug insulator. According to this invention, the plug insulator further comprises a pair of first plug-side engaging portions respectively formed on outer surfaces of opposite end walls of the envelope portion which surfaces extend in parallel to a third plane perpendicular to the first plane and at least one second plug-side engaging portion formed on at least a single position of a part of the surrounding portion, which part extends in parallel to the first plane. The receptacle insulator further comprises a pair of the first receptacle-side engaging portions formed on inner surfaces of opposite end walls of the receiving portion which surfaces extend in parallel to a fourth plane perpendicular to the second plane, at least one of the first receptacle-side engaging portions being engaged with at least one of the first plug-side engaging portions to releasably fix the plug insulator to the receptacle insulator with the envelope portion inserted into the receiving portion when the plug connector is fitted to the receptacle connector, and at least one second receptacle-side engaging portion formed on at least one position of a part of the receiving portion which part extends in parallel to the second plate, the at least one second receptacle-side engaging portion being engaged with the at least one second plug-side engaging portion to releasably fix the plug insulator to the receptacle insulator.

DESCRIPTION OF THE PREFERRED EMBODIMENTS

Figure 1:
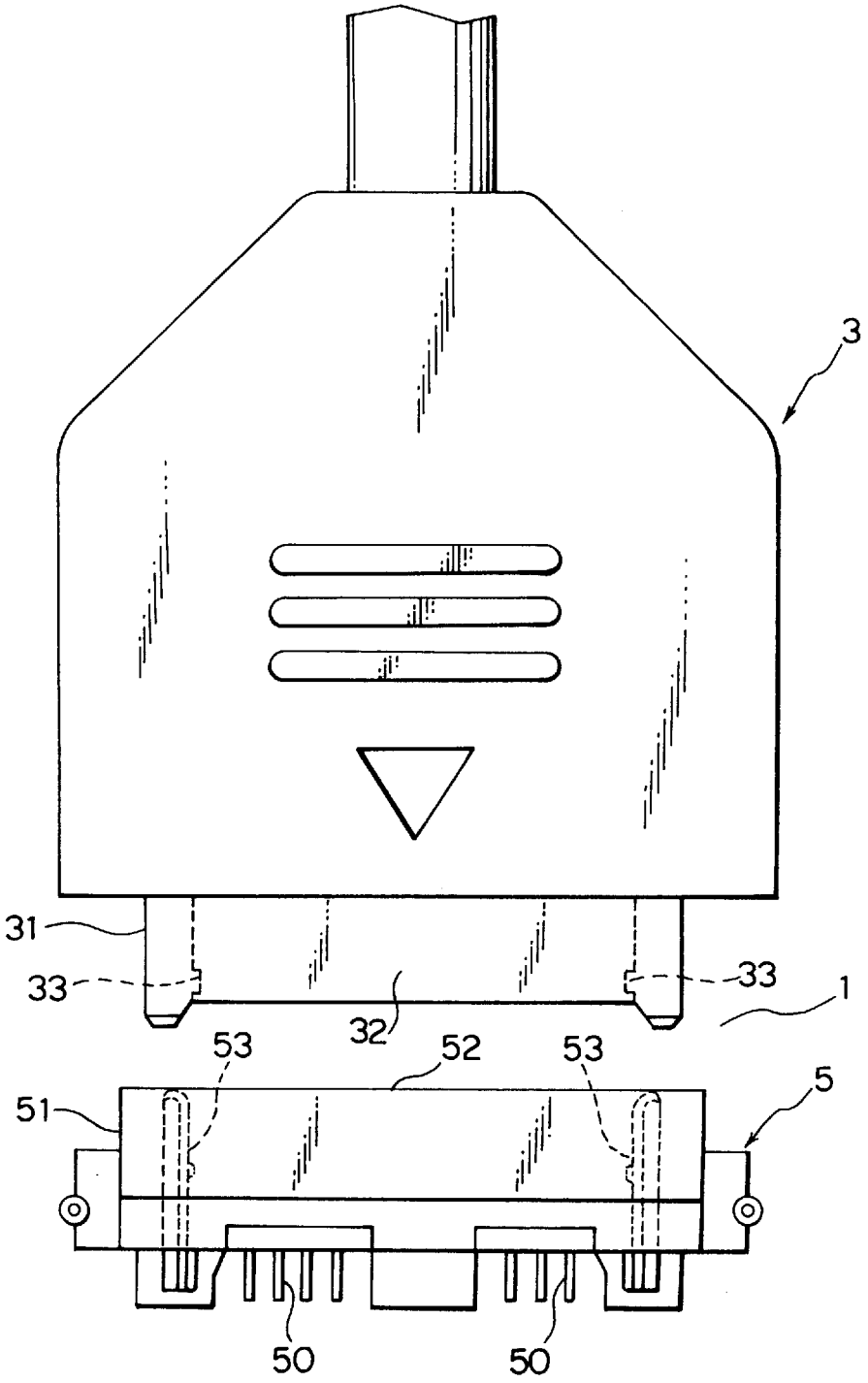
PRIOR ART FIG. 1
FIG. 1 is a bottom view of a conventional interface connector in a condition where a plug connector and a receptacle connector are separated from each other.
Figure 2:
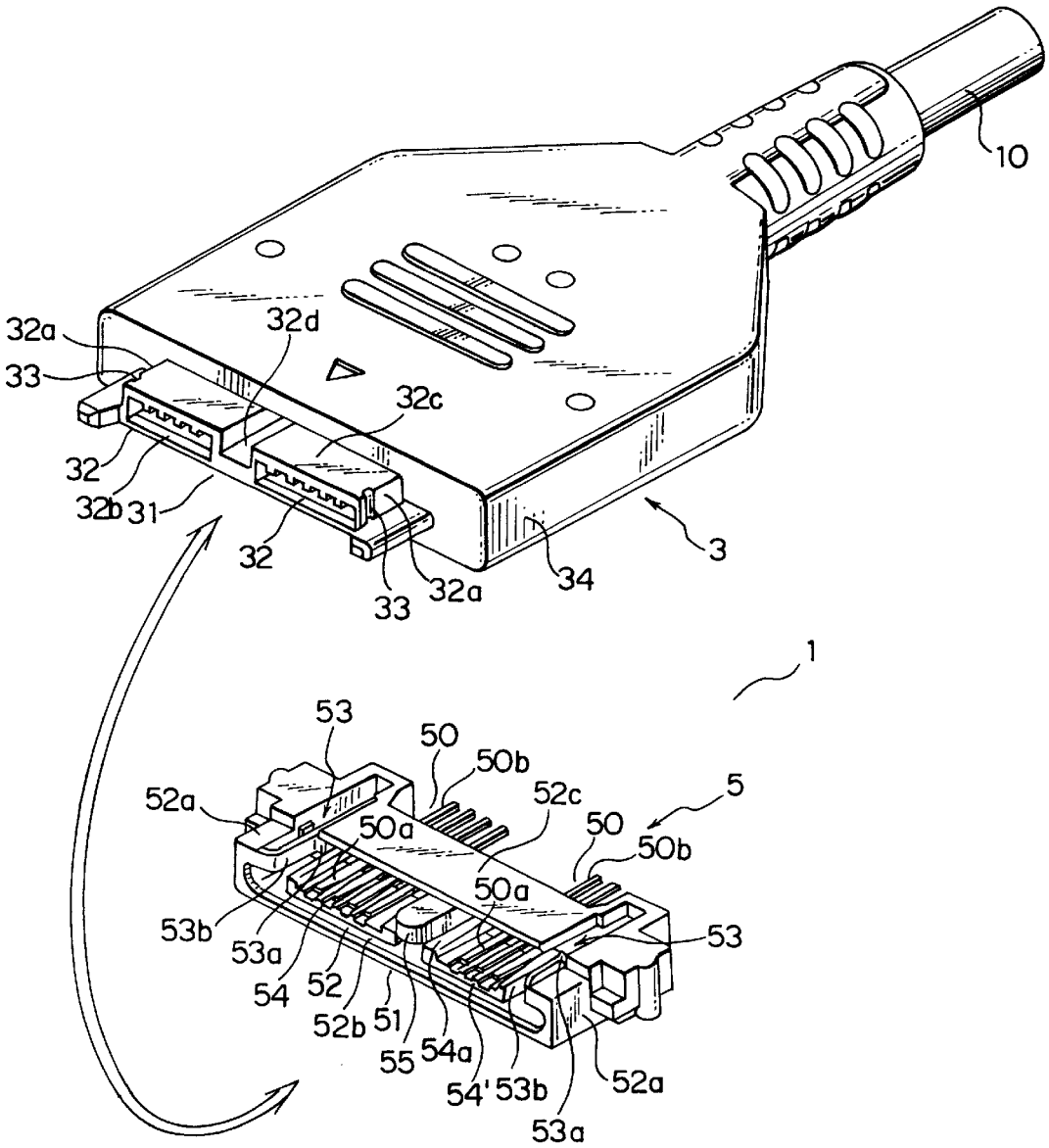
FIG. 2 is a perspective view of an interface connector according to a first embodiment of this invention in a condition where a plug connector and a receptacle connector are separated from each other.
Figure 3:
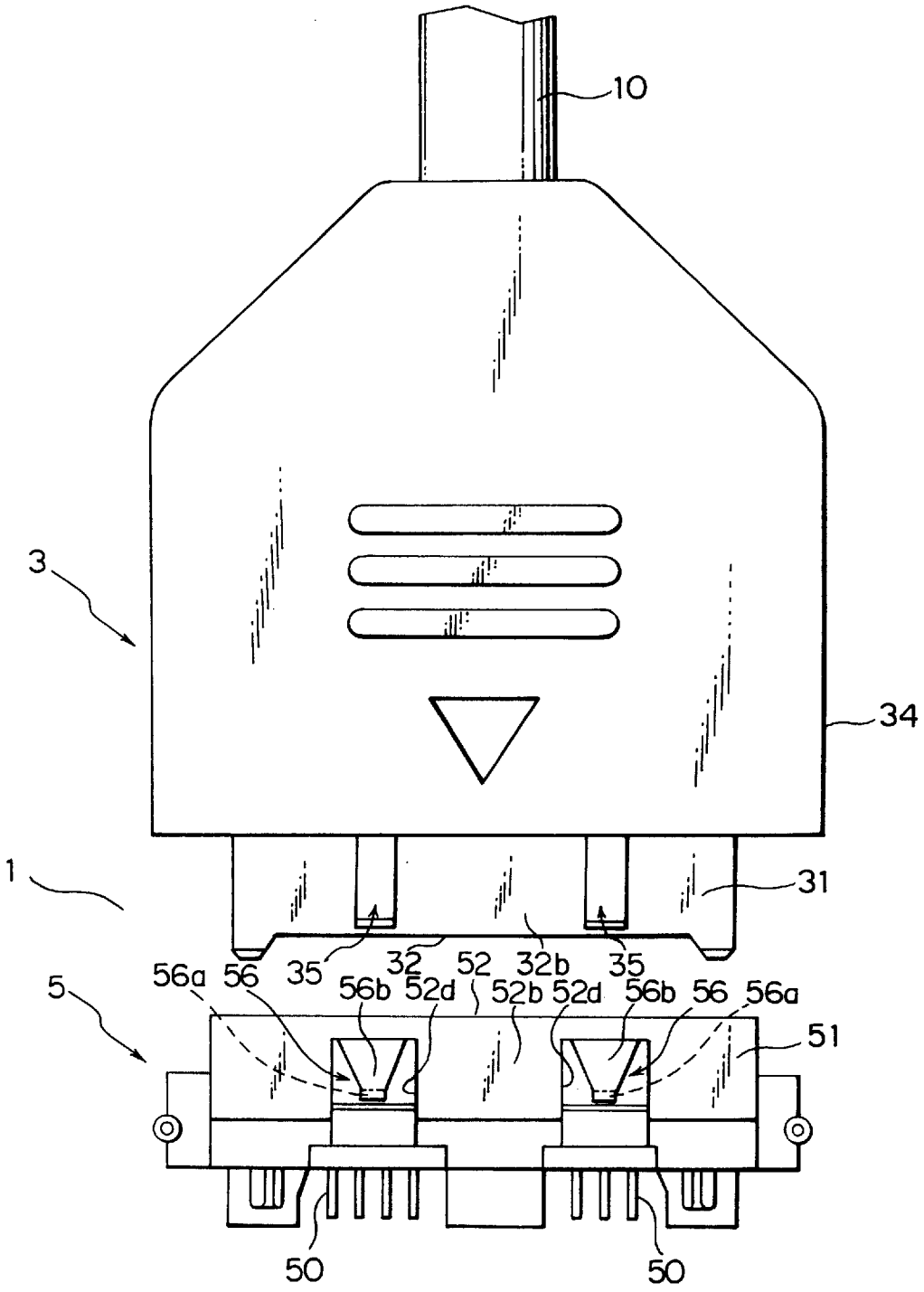
FIG. 3 is a bottom view of the interface connector illustrated in FIG. 2 in a condition immediately before the plug connector and the receptacle connector are connected to each other.
Figure 4:
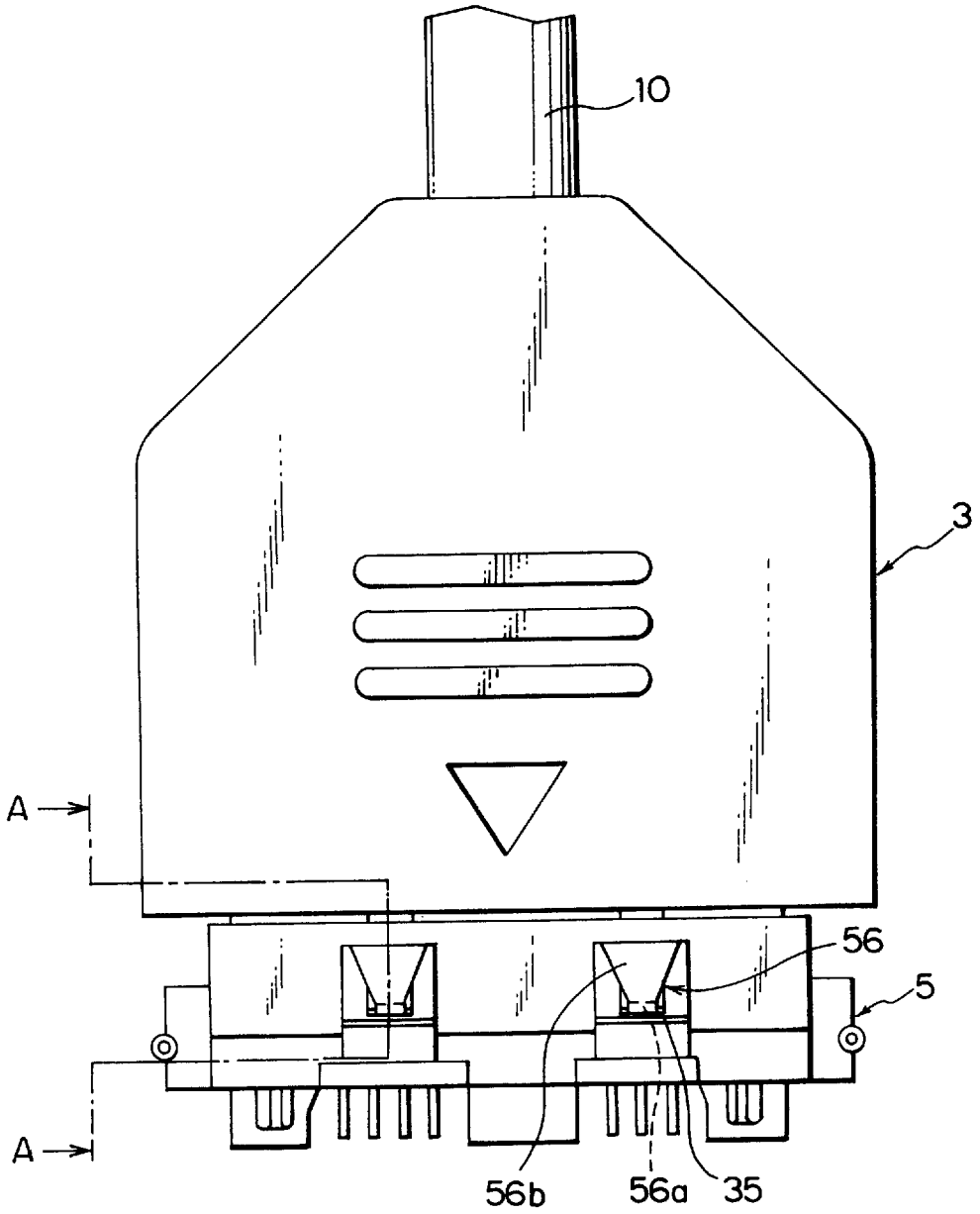
FIG. 4 is a bottom view of the interface connector illustrated in FIG. 2 in a condition where the plug connector and the receptacle connector are connected to each other.
Figure 5:
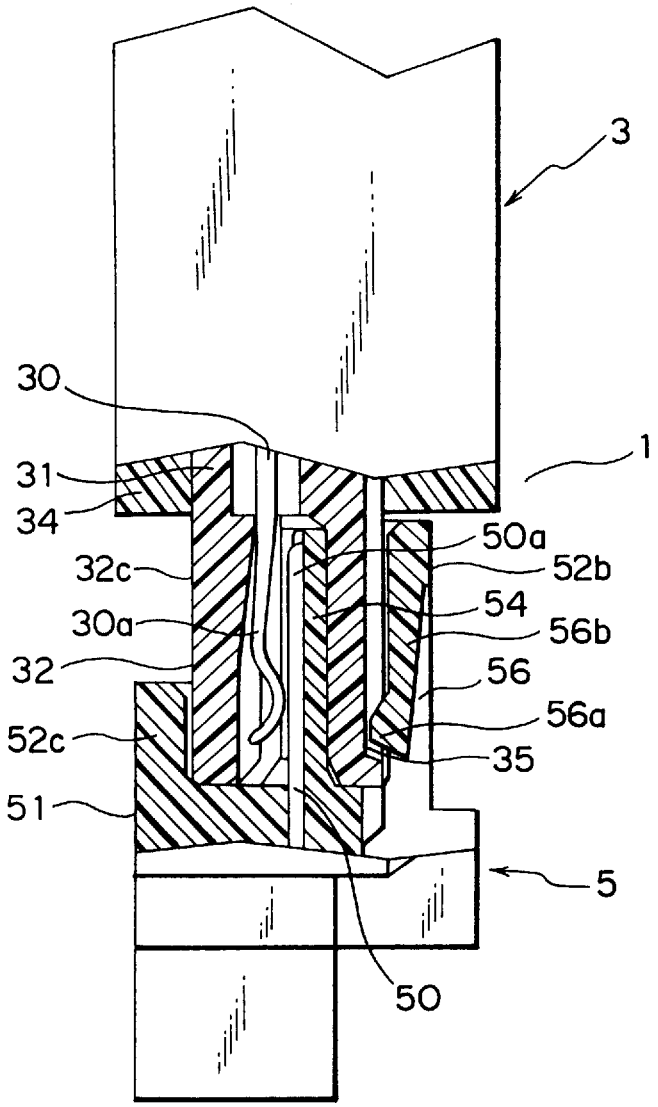
FIG. 5 is an enlarged sectional view taken along a line A—A in FIG. 4.

For a better understanding of this invention, description will at first be made as regards a conventional connector with reference to the drawing.

Referring to FIG. 1, the conventional connector 1 comprises a plug connector 3 and a receptacle connector 5 to be connected to the plug connector 3 as a mating connector in a coupling direction.

The plug connector 3 comprises a plurality of first contract elements (not shown) and a plug insulator 31.

The first contact elements are arranged on a first plane (not shown) in parallel to one another. Each of the first contact elements has a first contacting portion (not shown). The first contact elements are preferably made of a material such as Cu—Sn alloy.

The plug insulator 31 holds the first contact elements and is provided with an envelope portion 32 which surrounds the first contacting portions. There is a space between the envelope portion 32 and the first contacting portions. The plug insulator 31 is preferably made of synthetic resin.

The receptacle connector 5 comprises a plurality of second contact elements 50 and a receptacle insulator 51.

The second contact elements 50 are arranged on a second plane (not shown) in parallel to one another. Each of the second contact elements 50 has a second contacting portion (not shown) to be brought into contact with a corresponding one of the first contacting portions. The second contact elements 50 are also preferably made of a material such as Cu—Sn alloy.

The receptacle insulator 51 holds the second contact elements 50 and is formed with a receiving portion 52 which surrounds the second contacting portions so as to receive the envelope portion 32 of the plug insulator 31. The receptacle insulator 51 is preferably made of synthetic resin.

The plug insulator 31 further comprises a pair of first plug-side engaging portions 33, The first plug-side engaging portions 33 are formed on outer surfaces of opposite end walls of the envelope portion 32, which surfaces extend in parallel to a third plane (not shown) perpendicular to the first plane and are faced to the receiving portion 52 of the receptacle insulator 51. The first plug-side engaging portions 33 are engaged with first receptacle-side engaging portions 53, which will later be described, to releasably fix the plug insulator 31 to the receptacle insulator 51 with the envelope portion 32 inserted into the receiving portion 52.

The receptacle insulator 51 further comprises a pair of the first receptacle-side engaging portions 53. The first receptacle-side engaging portions 53 are formed on inner surfaces of opposite end walls of the receiving portion 52, which surfaces extend in parallel to a fourth plane (not shown) perpendicular to the second plane and are faced to the envelope portion 32 of the plug insulator 31. The first receptacle-side engaging portions 53 are engaged with the first plug-side engaging portions 33 to releasably fix the plug insulator 31 to the receptacle insulator 51 with the envelope portion 32 inserted into the receiving portion 52.

Now, description will proceed to a connector according to a first embodiment of this invention with reference to FIGS. 2 through 5.

Similar components as those described in conjunction with the conventional connector are designated by like reference numerals.

The first embodiment illustrated in FIGS. 2 through 5 is applied to an interface connector used in a modem. The interface connector 1 comprises a plug connector 3 and a receptacle connector 5, like the conventional connector illustrated in FIG. 1.

The plug connector 3 is connected to a cable 10 and comprises first contact elements 30, seven in number, and a plug insulator 31.

Each of the first contact elements 30 is formed into a generally rod shape and has a first contacting portion 30*a* at one end thereof and a terminal portion (not shown) at the other end. The terminal portion is connected to one of electric wires of the cable 10. The first contact elements 30 are divided into two groups. In each group, the first contact elements 30 are arranged on a first plane in parallel to one another at a predetermined pitch.

The plug insulator 31 holds the first contact elements 30. The plug insulator 31 is provided with an envelope portion 32 which is formed to surround the first contacting portions 30*a* of the first contact elements 30. The envelope portion 32 comprises opposite end walls 32*a* extending in parallel to a third plane perpendicular to the first plane, a bottom wall 32*b* parallel to the first plane, and a top wall 32*c* parallel to the first plane. The top wall 32*c* has a recessed portion 32*d* formed at its center to partition the inside of the envelope portion 32 into two compartments. In one of the compartments, the first contact elements 30, three in number, are arranged. In the other compartment, the first contact elements 30, four in number, are arranged. The plug insulator 31 is entirely covered by an outer cover 34 made of plastic except the envelope portion 32.

The receptacle connector 5 is located in a modem (not shown) with a part thereof exposed. The receptacle connector 5 contains second contact elements 50, seven in number, and a receptacle insulator 51.

Each of the second contact elements 50 is formed into a generally rod shape and has a second contacting portion at its one end and a terminal portion 50*b* at the other end. The terminal portions 50*b* are connected to a printed circuit board (not shown) in the modem. The second contact elements 50 are divided into two groups in correspondence to the first contact elements 30. In each group, the second contact elements 50 are arranged on a second plane in parallel to one another at a predetermined pitch.

The receptacle insulator 51 holds the second contact elements 50. The receptacle insulator 51 is provided with a receiving portion 52 which is formed to surround the second contacting portions 50*a* of the second contact elements 50, and is for receiving the envelope portion 32 of the plug insulator 31 when the plug connector 3 is fitted to the receptacle connector 5. The receiving portion 52 comprises opposite end walls 52*a* parallel to a fourth plane perpendicular to the second plane, a bottom wall 52*b* parallel to the second plane, a top wall 52*c* parallel to the second plane. The bottom wall 52*b* is provided with two holes 52*d*. The receptacle insulator 51 further comprises two contact elements holding portions 54 and 54' and a partitioning portion 55. Each of the contact element holding portions 54 and 54' is formed in the receiving portion 52 and holds the second contact elements 50 in correspondence to the first contact elements 30 held by the plug insulator 31. One contact element holding portion 54' is provided with a guide 54*a* for smooth connection of a small plug connector (not shown) to be connected only to the second contact elements 50 held by the contact element holding portion 54'. The partitioning portion 55 is formed on the inner surface of the top wall 52*c* at a center thereof. The partitioning portion 55 is inserted into the recessed portion 32*d* of the plug insulator 31 when the plug connector 3 is connected to the receptacle connector 5.

The plug insulator 31 has a pair of first plug-side engaging portions 33, like in the conventional connector. The first plug-side engaging portions 33 are formed on outer surfaces of the opposite end walls 32*a* of the envelope portion 32. The first plug-side engaging portions 33 comprise first recessed portions.

The plug insulator 31 further comprises a pair of second plug-side engaging portions 35 which the conventional connector does not have. The second plug-side engaging portions 35 are formed in parallel to each other on an outer surface of the bottom wall 32*b* of the envelope portion 32, which surface is faced to the receiving portion 52 when the plug connector is fitted to the receptacle connector. Each of the second plug-side engaging portions 55 comprises a second recessed portion in the shape of an elongated groove extending over a predetermined length along the first contact elements 30 with opposite end walls. The second plug-side engaging portions 35 are engaged with second receptacle-side engaging portions 56, which will later be described, to releasably fix the plug insulator 31 to the receptacle insulator 51 with the envelope portion 32 inserted into the receiving portion 52. In this embodiment, the second plug-side engaging portions 35, two in number, are formed on the plug insulator 31. It will be understood here that the number of the second plug-side engaging portions 35 formed on the plug insulator may be one or three or more. In this embodiment, the second plug-side engaging portions 35 are formed on the bottom wall 32*b* of the envelope portion 32. Alternatively, the second plug-side engaging portions 35 may be formed at any other part of the envelope portion that is parallel to the first plane and is faced to the receiving portion of the receptacle insulator.

The receptacle insulator 51 has a pair of first receptacle-side engaging portions 53, like in the conventional connector. The first receptacle-side engaging portions 53 are respectively formed on inner surfaces of the opposite end walls 52*a*. Each of the first receptacle-side engaging portions 53 comprises a first protrusion 53*a* and a first arm 53*b*. The first protrusion 53*a* is formed on the first arm 53*b* and fitted into the first plug-side engaging portion 33 corresponding thereto when the envelope portion 32 is inserted into the receiving portion 52. The first arm 53*b* is formed on each of the opposite end walls 52*a* of the receiving portion 52. The first arm 53*b* has elasticity and presses the first protrusion 53*a* so that the first protrusion 53*a* enters into the first plug-side engaging portion 33. The first receptacle-side engaging portions 53 are engaged with the first plug-side engaging portions 33 in the coupling direction to lock the plug insulator 31 to the receptacle insulator 51 with the envelope portion 32 inserted into the receiving portion 52.

The receptacle insulator 51 is provided with a pair of second receptacle-side engaging portions 56 which the conventional connector does not have. The second receptacle-side engaging portions 56 are formed in parallel to each other on an inner surface of the bottom wall 52*b* of the receiving portion 52, which surface is faced to the envelope portion 32. Each of the second receptacle-side engaging portions 56 has a second protrusion 56*a* and a second arm 56*b*. The second protrusion 56*a* is formed on the second arm 56*b* and fitted into the second plug-side engaging portion 35 corresponding thereto when the envelope portion 32 is inserted into the receiving portion 52. The second arms 56*b* project from inner walls of the holes 52*d* formed in the bottom wall 52*b*, respectively. The second arms 56*b* have elasticity. When the envelope portion 32 is inserted into the receiving portion 52, the second arms 56*b* are opposite to the second recessed portions of the second plug-side engaging portions 35 to make the second protrusions 56*a* enter into the second recessed portions of the second plug-side engaging portions 35. When the second protrusions 56*a* are entered into the second recessed portions of the second plug-side engaging portions 35, the second receptacle-side engaging portions 56 are engaged with the inner surfaces of the second recessed portions of the second plug-side engaging portions 35 in the predetermined direction to lock the plug insulator 31 to the receptacle insulator 51. It is possible to disengage the plug 3 from the receptacle 5 by elastically bending the second arm 56*b* outwardly until the second protrusion 56*a* come out of the second recessed portions of the second plug-side engaging portions 35. In this embodiment, the second receptacle-side engaging portions 56, two in number, are formed on the receptacle insulator 51. It will be understood that the number of the second receptacle-side engaging portions formed on the receptacle insulator may be one or three or more. In this embodiment, the second receptacle-side engaging portions 56 are formed on the bottom wall 52*b* of the receiving portion 52. Alternatively, the second receptacle-side engaging portions 56 may be formed at any other part of the receiving portion that is parallel to the second plane and faced to the envelope portion of the plug insulator.

Figure 6:
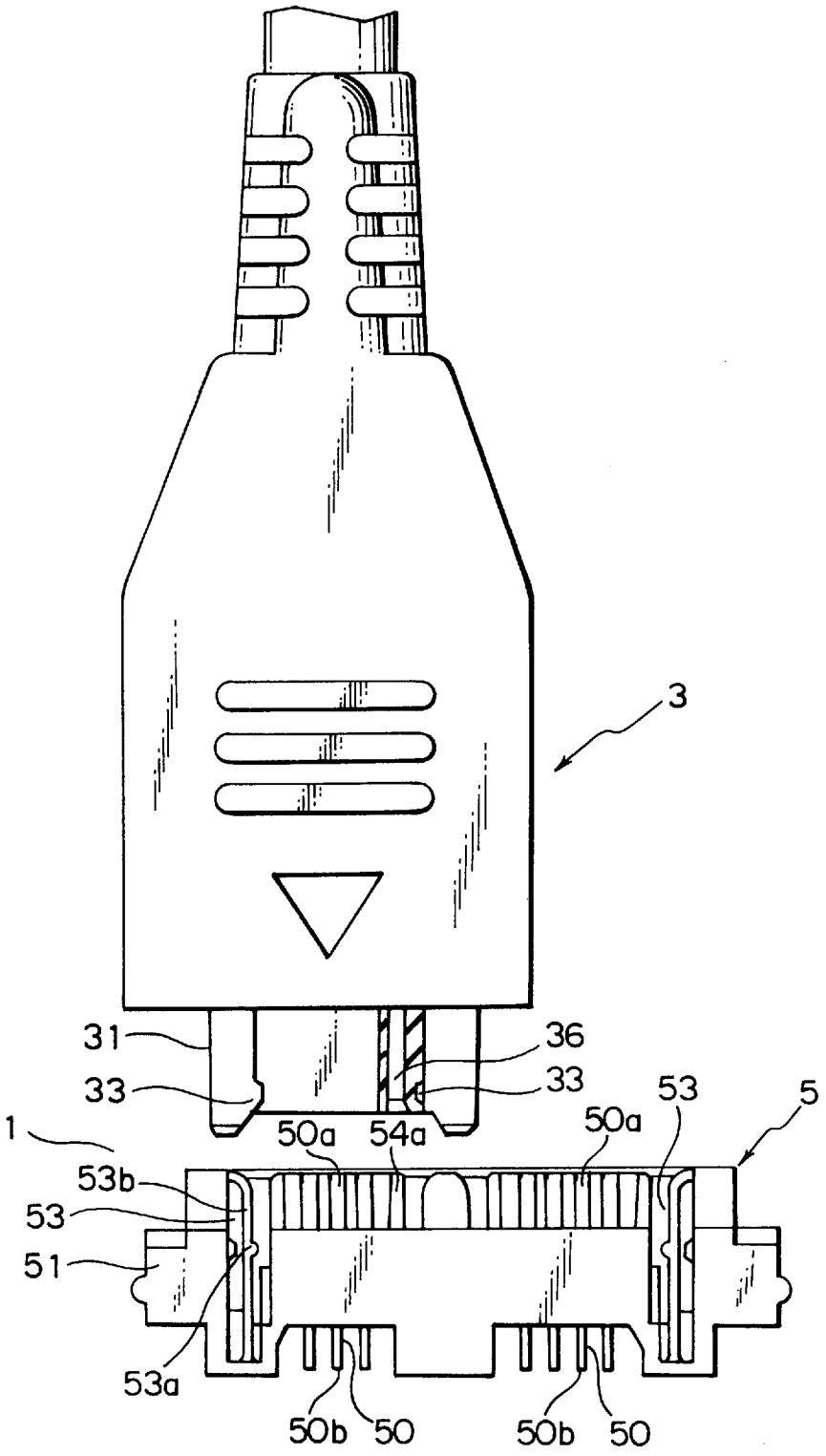
FIG. 6 is a plan view of an interface connector according to a second embodiment of this invention in a condition immediately before a plug connector and a receptacle connector are connected to each other.
Figure 7:
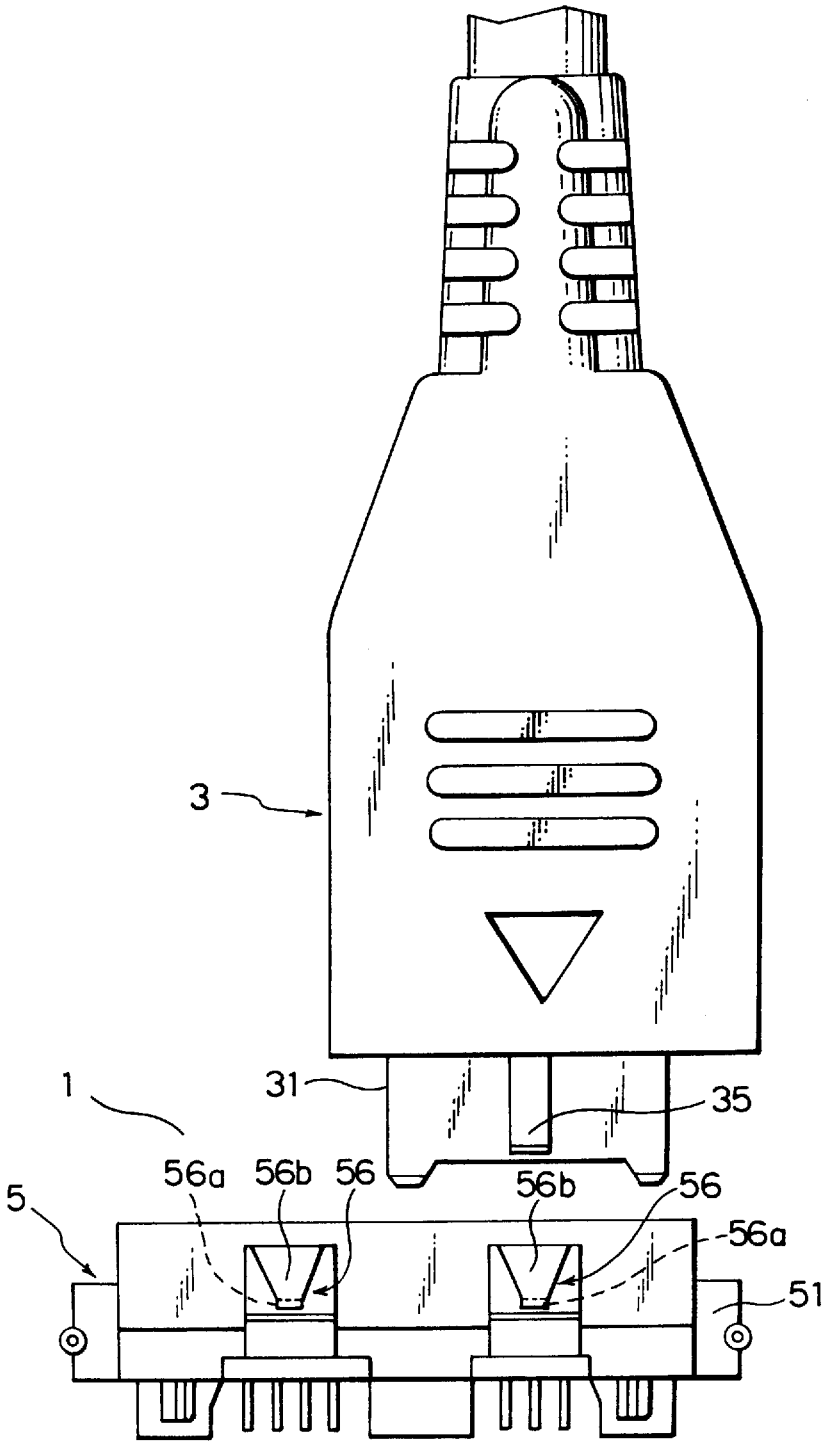
FIG. 7 is a bottom view of the interface connector illustrated in FIG. 6 in the similar condition.

Next, description will proceed to a second embodiment of this invention with reference to FIGS. 6 and 7.

Similar components are designated by like reference numerals as in the first embodiment.

A connector according to the second embodiment is an interface connector similar to the first embodiment and comprises a combination of a plug connector 3 and a receptacle connector 5.

The receptacle connector 5 has a structure equivalent to that of the first embodiment and, therefore, will not be described any longer.

Likewise, the plug connector 3 has a similar structure similar to that of the first embodiment except some differences which will presently be described.

The plug connector 3 according to the second embodiment contains three first contact elements 30 which are less in number than second contact elements 50 of the receptacle connector 5. Accordingly, the plug connector 3 is connected to one side (where the three of the second contact elements 50 are arranged) of the receptacle connector 5. The plug connector 3 is provided with first plug-side engaging portions 33, two in number, in the manner similar to the plug connector 3 according to the first embodiment. However, only one second plug-side engaging portion 35 is provided in the manner different from the plug connector 3 according to the first embodiment. The second plug-side engaging portion 35 is engaged with one of the second receptacle-side engaging portions 56 of the receptacle connector 5. In the connector of the second embodiment, only one of the two plug-side engaging portions 33 is engaged with the first plug-side engaging portions 53. However, the second plug-side engaging portion 35 is engaged with one of the second receptacle-side engaging portions 56. It is therefore possible to prevent the plug connector 3 from being readily released from the receptacle connector 5.

The plug insulator 31 is provided with a positioning hole 36. The positioning hole 36 is for receiving a guide 54*a* formed on a contact holding portion 54' of the receptacle insulator 51. With this structure, the plug connector 3 is accurately position with respect to the receptacle connector 5 so as to enable smooth connection between the plug connector 3 and the receptacle connector 5.

What is claimed is:

1. A connector comprising a combination of a plug connector and a receptacle connector which are connected as a mating connector responsive to a sliding of said plug into said receptacle, said sliding being in a coupling direction, each of said plug and receptacle having a plurality of contacts, wherein said plug may include a number of contacts which are different than the number of contacts in said receptacle, whereby there may be an unbalanced mechanical force when said plug is inserted into or removed from said receptacle, said plug connector comprising:

a first plurality of said contacts having first contacting portions, respectively, said first contacting portions being arranged in parallel to one another in at least a first row; and A plug insulator holding said first contacts, said plug insulator having an envelope portion with two opposite end walls and two opposite side walls which surround said first contacting portions;

said receptacle connector comprising:

a second plurality of said contacts having second contacting portions positioned to be brought into contact with said first contacting portions, respectively, and arranged in parallel with each other in a second row; and a receptacle insulator holding said second contacts and having a receiving portion which surrounds said second contacting portions so as to receive said envelope portion of said plug insulator when said plug connector is fitted into said receptacle connector when said first and second rows come into mating contact, said receiving portion having two opposite end walls and top and bottom walls which confront the corresponding end walls and said side walls of said plug, said bottom wall containing at least one hole;

wherein said plug insulator further comprises:

a pair of first plug-side engaging portions respectively formed on outer end wall surfaces of said envelope portion, said plug-side engaging portions extending in parallel with each other and perpendicular to said first row; and at least one second plug-side engaging portion formed on at least one of said side walls of said envelope portion, said at least one second plug-side engaging portion comprising at least one recessed portion extending in parallel with said first row;

said receptacle insulator further comprises;

a pair of first receptacle-side engaging portions formed on the inner end wall surfaces of said opposite end walls of said receiving portion, said inner wall surfaces of said receptacle insulator extending in parallel with each other and perpendicular to said second row, at least one of said first receptacle-side engaging portions being engaged with at least one of said first plug-side engaging portions in said coupling direction to lock said plug insulator to said receptacle insulator with said envelope portion inserted into said receiving portion when said plug connector is filled to said receptacle connector; and said bottom wall having a pair of locking arms, each of said locking arms having a protrusion to be fitted into a corresponding recessed portion of said plug housing, said each of said locking arms pressing said protrusion into said corresponding recessed portion of said plug, at least one of said pair of locking arms fitting into said at least one hole, each of said locking arms being a cantilever extending inwardly from an edge of said hole toward said receiving portion of said bottom wall containing said hole and extending in a coupling direction.

2. A connector as claimed in claim 1, wherein said first contact elements are equal in number to said second contacts.

3. A connector as claimed in claim 1, wherein said first contact elements are less in number than said second contacts.

4. A connector as claimed in claim 1, wherein said first plug-side engaging portions has two of said recessed portions, each of said pair of locking arm having a protrusion to be fitted into a corresponding one of said two recessed portions, each of said locking arms being for pressing said protrusion to enter into a corresponding one of said recessed portion.

5. A connector as claimed in claim 1, wherein said second plug-side engaging portions are formed on at least two positions of a part of said envelope portion that is parallel to said first row of contacts and face toward said receiving portion, respectively, said second receptacle-side engaging portions being formed on at least two positions of a part of said receiving portion that is parallel to said first row of contacts and faced to said envelope portion.

* * * * *